US006913142B2

(12) United States Patent
Gray

(10) Patent No.: US 6,913,142 B2
(45) Date of Patent: Jul. 5, 2005

(54) FLEXIBLE DUCT PACKAGING RESTRAINT AND CONTAINER AND METHOD FOR RESTRAINING AND CONTAINING

(76) Inventor: William R. Gray, 5321 Blue Sage Dr., Raleigh, NC (US) 27606

( * ) Notice: Subject to any disclaimer, the term of this patent is extended or adjusted under 35 U.S.C. 154(b) by 0 days.

(21) Appl. No.: 10/139,899

(22) Filed: May 7, 2002

(65) Prior Publication Data

US 2003/0209456 A1 Nov. 13, 2003

(51) Int. Cl.[7] ..... B65D 85/14

(52) U.S. Cl. ..... 206/321; 53/436; 206/446; 229/132

(58) Field of Search ..... 229/132, 122, 229/164; 53/436–438; 206/291, 321, 418, 446, 738

(56) References Cited

U.S. PATENT DOCUMENTS 3,869,077 A * 3/1975 Tuura ..... 229/117.16
4,498,590 A * 2/1985 Burdick ..... 206/581
4,987,996 A * 1/1991 Anderson ..... 206/321
5,011,021 A * 4/1991 Coltrane et al. ..... 229/122
5,148,940 A * 9/1992 Mendise ..... 229/117.35
5,533,367 A 7/1996 Lybarger et al.
5,669,496 A 9/1997 Daniels
5,738,216 A 4/1998 Warner

* cited by examiner

*Primary Examiner*—Jim Foster
(74) *Attorney, Agent, or Firm*—Brian B. Shaw, Esq.; Roger Aceto, Esq.; Harter, Secrest & Emery LLP

(57) ABSTRACT

A container for a compressible article is disclosed, wherein the container includes first and second opposed sides having a first length, a first pair of flaps or edge attached to an end of the first and second opposed sides defining an end of the container, third and fourth opposed sides capable of having a second shorter length; and a second pair of flaps or edges attached to the third and fourth sides, the second pair of flaps having a fold line approximately aligned with the end of the container.

9 Claims, 8 Drawing Sheets

FLEXIBLE DUCT PACKAGING RESTRAINT AND CONTAINER AND METHOD FOR RESTRAINING AND CONTAINING

FIELD OF THE INVENTION

The present invention relates to restraints and containers, and more particularly to a restraint and a container in cooperation with a plunger and related method for retaining a longitudinally compressible article.

BACKGROUND OF THE INVENTION

Flexible duct used for transfer of heated or cooled air or other gases is typically designed for low-pressure usage, e.g. about 3 to 5 inches of water pressure. The duct is normally composed of an inner liner reinforced by a helical strand as of metal or plastic, a thick layer of flexible insulation such as fibrous glass around the liner, the insulation being surrounded by a flexible plastic, i.e. polymeric, jacket. As is well known, shipping, handling and storage costs and convenience are substantially improved by axially compressing the flexible duct into a small container, typically an elongated box, having a length only a small fraction of the initial hose length in its free state. One problem in particular relates to maintaining a length of packaged length of duct in its compressed state while the container is being loaded and closed for transport.

One technique employs a mechanical retaining tool to temporarily engage the compressed duct. This tool has prongs which are inserted through openings in a wall of the container, near the end through which the duct was admitted, so that the prongs engage the end of the compressed duct and physically hold the compressed duct in place until the open end of the container is closed. The tool is then withdrawn and the compressed duct is free to expand as far as the newly closed end of the box. This technique requires that special tooling must be provided to cut openings for the prongs into the blank from which the box is made. In addition, the presence of holes in the container can lead to contamination of the duct during transport or storage. Further, the formation of the holes in the container add to the cost of the container.

Therefore, a need exists for a packaging restraint and container that can retain a longitudinally compressed article, without requiring special manufacturing considerations. The need also exists for a container that can be readily manufactured. A further need exists for a container that can effectively seal the compressed article.

SUMMARY OF THE INVENTION

The present invention provides a restraint and a container for retaining a compressed article, wherein the article can be retained within the container without requiring the formation of secondary openings in the container. The container of the present invention is readily formed from a blank, wherein the blank may be any of a variety of materials, including paperboard, cardboard, plastic, composites and laminates.

The container is constructed to permit a partial closure sufficient to capture the compressed article within the container with or without the restraint, while a retaining device retains a compressed article within the container. The container includes primary flaps which, once the compressed article has been admitted through an open end of the container, are used to hold the article in place after the retaining device is removed. Secondary flaps are then engaged to completely close the container and maintain the article in the compressed state.

DETAILED DESCRIPTION OF THE PREFERRED EMBODIMENTS

Figure 1:
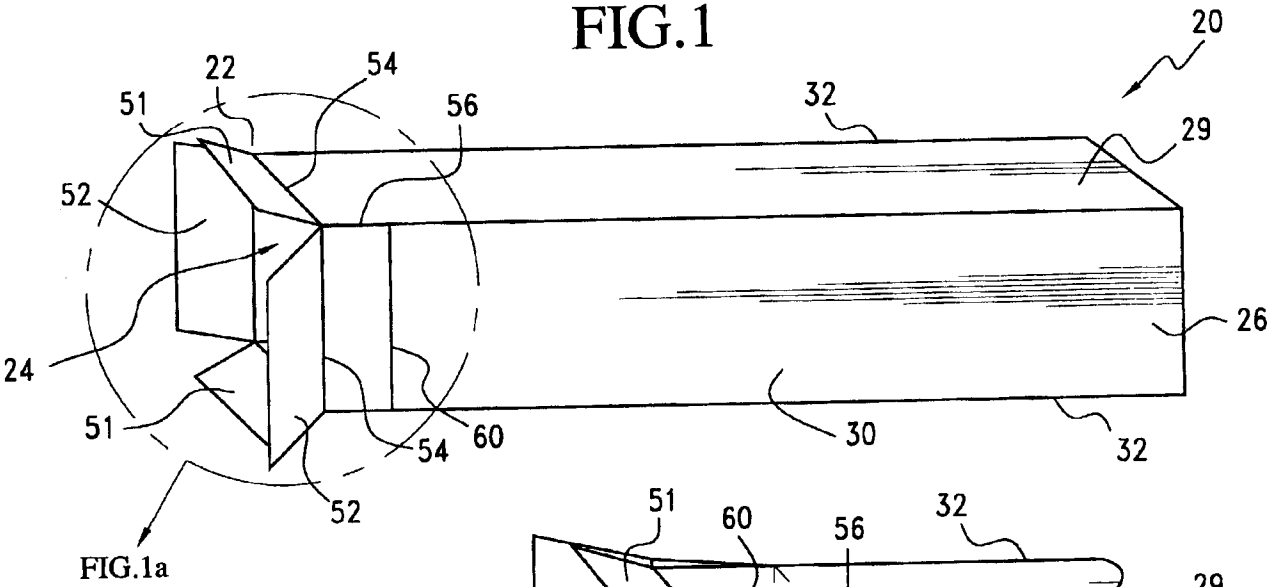
FIG. 1 is a perspective view of a container, including an area of detail in FIG. 1*a*.
Figure 2:
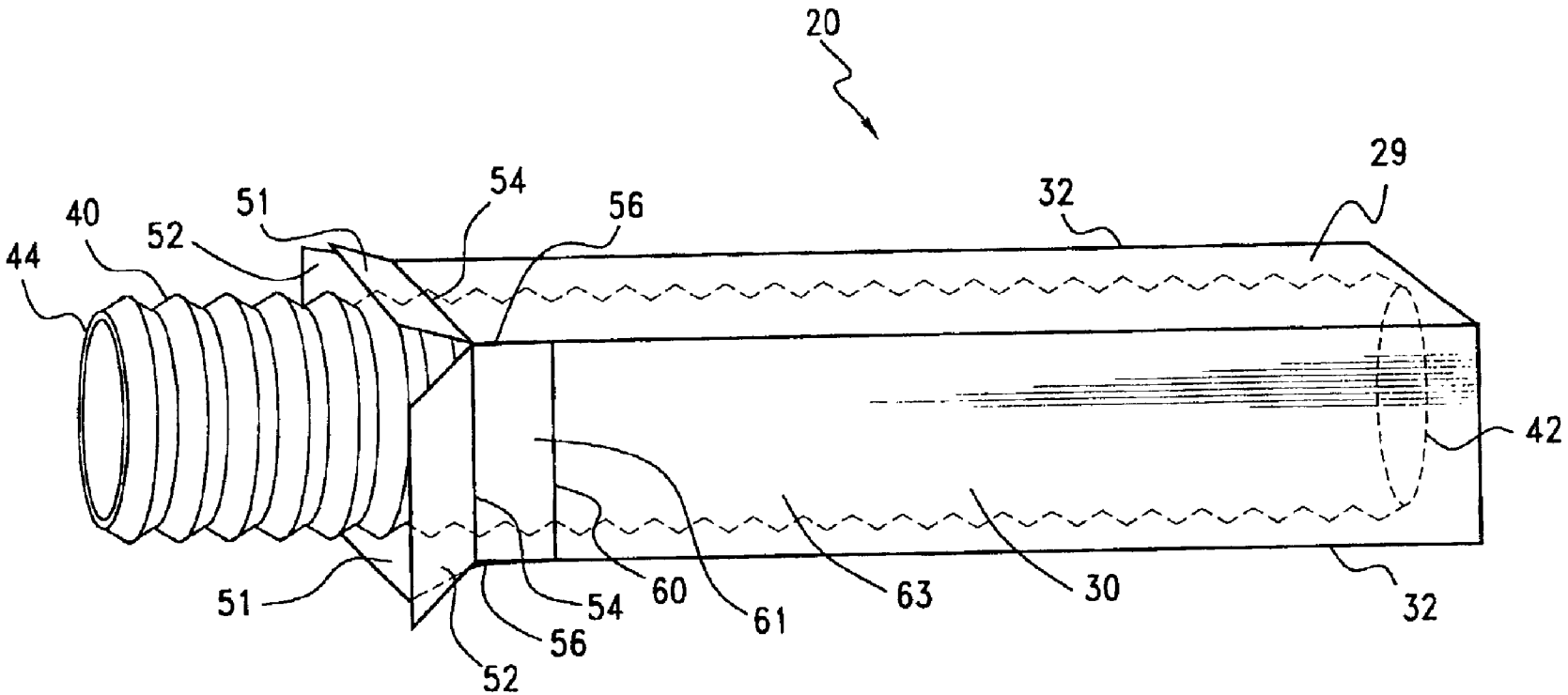
FIG. 2 is a perspective view of the container with a compressible but uncompressed article, which fills the length of the container and also extends longitudinally outside an open end thereof.

Referring to FIG. 1, a packaging container 20 is shown. The container 20 has the general shape of an elongated cube, with a first end 22 in which is provided an opening 24, a dosed end 26, and four walls which are formed by a first pair of parallel walls 29 preferably of substantially equal given witdh and a second pair of parallel walls 30 preferably of substantially equal given width. Adjacent walls meet at corners 32. FIG. 2 shows the container 20 with a compressible article 40 inserted therein through the opening 24. The article 40 is depicted in an uncompressed form, with a leading end 42 abutting the closed end 26 of the container 20, and a trailing end 44 projecting outside the container 20.

The container 20 includes retaining flaps 51 and closure flaps 52 at the first end 22 preferably the retaining flags 51 and closures flaps 52 have a length of approximately one-half the width. The retaining flaps 51 are connected to the first pair of parallel walls 29 and the closure flaps 52 are connected to the second pair of parallel walls 30.

Each of the retaining flaps 51 and the closure flaps 52 includes a closing fold line 54. The closing fold line 54 for each retaining flap 51 and closure flap 52 lies in a common plane.

Figure 1A:
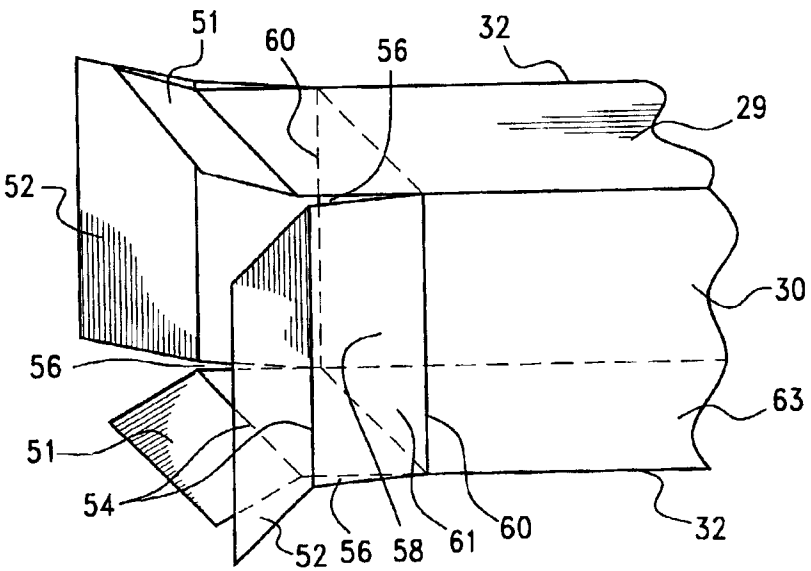

For the retaining flaps 51, the closing fold line 54 provides a folding connection between the flap and the wall 29. For the closure flaps 52, the closing fold line provides a folding within the length of the closure flap. The closure flaps 52 are connected to the respective wall 30 along a secondary fold line 60. The secondary fold lines 60 of the closure flaps lie in a limiting plane 58 (FIG. 1A) spaced from the closing fold lines 54. That is, the secondary fold lines 60 are nearer the closed end 26 than the closing fold lines 54.

Each closure flap 52 also includes a closing fold line 54 coplanar to the closing fold lines in the retaining flaps 51.

Therefore, the closure flaps 52 have a greater length than the retaining flaps 51. The greater length is provided by slits 56 extending along the corners 32 from the first end 22 to terminate at the limiting plane 58, which is generally perpendicular to each of the walls 29 and 30. Each of the parallel walls 30 has the secondary fold line 60, which lies in the limiting plane 58. The secondary fold line 60 provides that an end portion 61 of each wall 30 is free to be folded with respect to a main portion 63 of the corresponding wall 29, each end portion 61 being separated from the adjacent walls by the slits 56.

The walls 29 extend in a generally rigid manner between the fold line 54 and the closed end 26 of the container 20, while the walls 30 have generally rigid main portions 63 extending between the closed end 26 and the limiting plane 58, but have foldable end portions 61 between the limiting plane 58 and the first end 22.

Thus, the container includes the first pair of parallel opposed sides 29 and a second pair of shorter opposed sides 30, wherein the sides 29 include the retaining flaps 51 which define an end of the container and sides 30 include the closure flaps 52 which extend from the shorter sides 30 and include a fold line 60 generally aligned with the end of the container.

The walls 29 can also contain a score that is similar to that that forms the fold line 60 so that the described container has the closure flaps 52 constructed like the restraining flaps 51. Having the closure flaps 52 and the restraining flaps 51 constructed similarly would make container orientation non-relevant during the packaging process.

Figure 3:
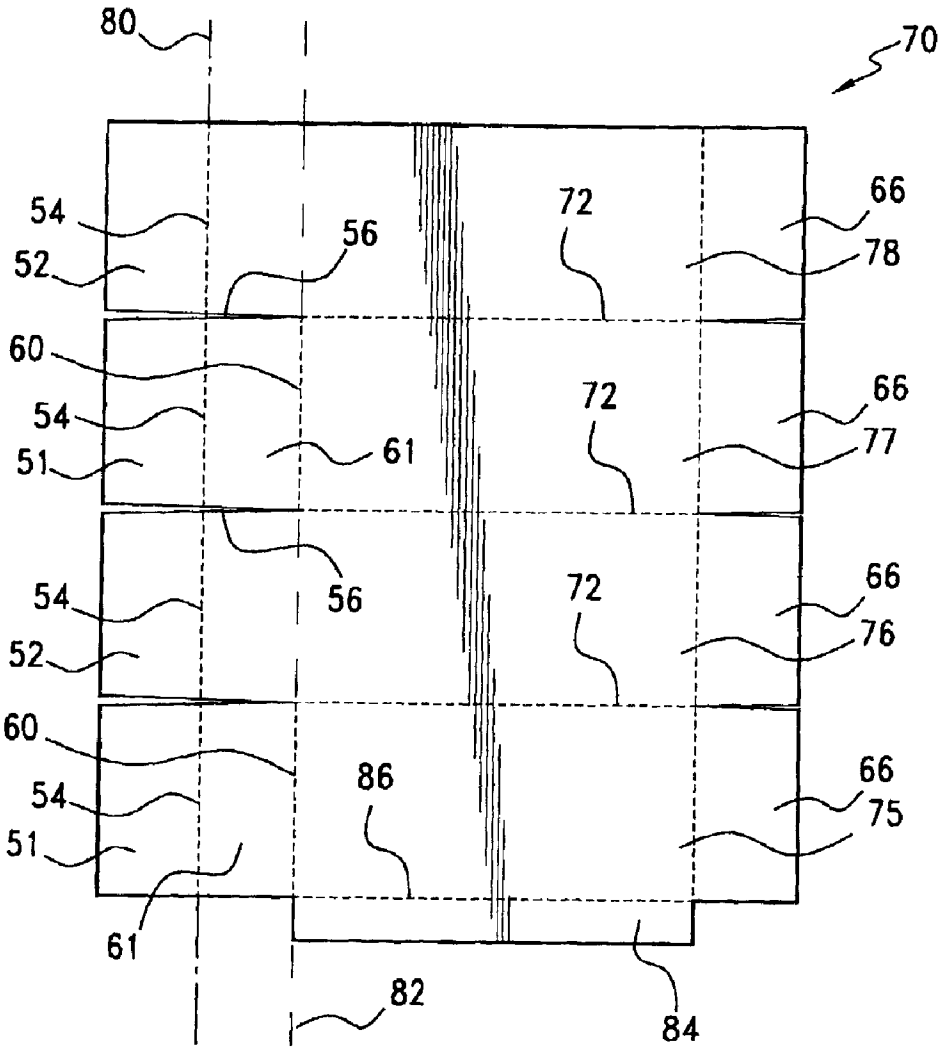
FIG. 3 is a plan view of a blank wherefrom the container can be fabricated.

A container blank 70, shown in FIG. 3, is a precursor for the container 20 itself, and is typically made from an integral piece of paperboard or like material. The blank 70 comprises four rectangular areas, each of which is joined to at least one neighboring area at one of a series of parallel corner fold lines 72. The areas are alternately designated first (A) and second (B) areas, and additionally as free (F) areas or interior (I) areas, depending on whether they are joined to one or two neighboring areas. Thus, in FIG. 3, the A-F, B-I, A-I and B-F areas are designated as 75, 76, 77 and 78 respectively. The first areas 75 and 77 correspond to the intended walls 30 of the intended container 20. An end line 80 defines the first end 22 of the intended container 20, and a slit 56 extends a short distance therefrom along each of the corner fold lines 72 to terminate at a limit line 82 which is parallel to the end line 80.

Each of the first and second areas 75 and 77, and 76 and 78, is foldably joined to a corresponding first or second flap 51 or 52 along the primary fold line 54 which lies along the end line 80. The end portions 61 of the first areas 75 and 77 are foldably attached to the main portions 63 thereof along secondary fold lines 60 which lie along the limit line 82. At an end of the blank opposed to the end line 80 are additional flaps 66 for closing the second end 26 of the intended container 20. A foldable adhesion flap 84 is joined along an edge fold line 86 to either of the free rectangular areas 75 or 78, to provide for gluing to the remaining free area 78 or 75. However, the join between the adhesion flap 84 and its neighboring rectangular area avoids the region between the limit 82 line and the end line 80, in order to provide for one of the slits 56 in the finished container 20.

The fabrication of the blank 70 requires no special tooling beyond that required for a conventional blank. The slits 56 which bound the end portions 61 are merely continuations of cuts which would be provided anyway to separate the first and second flaps 51 and 52. The secondary fold lines 60 can be provided merely by adjusting machinery which provides other fold lines.

The container 20 is employed as follows. The compressible article 40, for example a length of flexible duct, is inserted through the opening 24 until the leading end 42 of the article 40 abuts the closed end 26 of the container 20. The article 40 is then compressed into the container 20 by a suitable apparatus such as a ram or plunger, until the trailing end 44 has passed the end of the longer sides 29.

Figure 4:
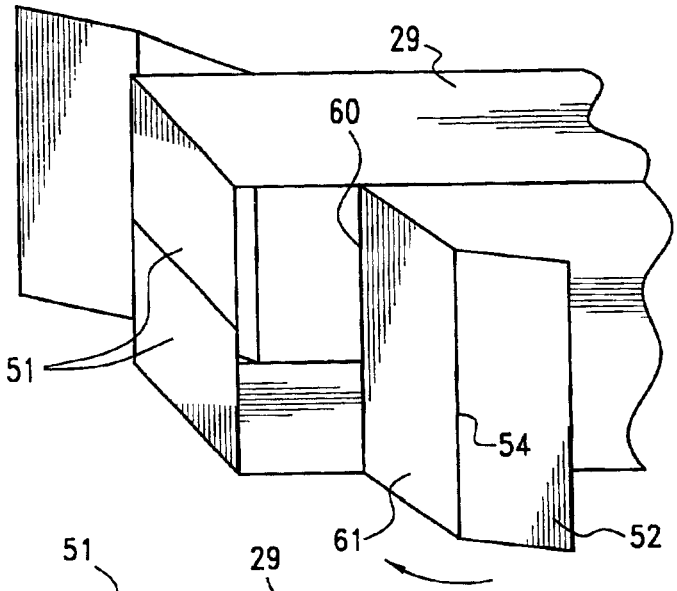
FIGS. 4–6 are perspective view of one end of a first configuration of the container at various stages of closure.
Figure 5:
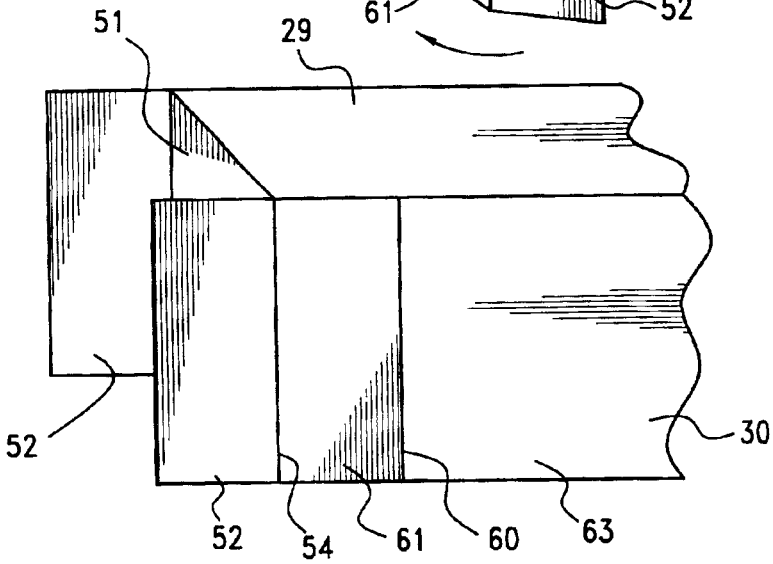
Figure 6:
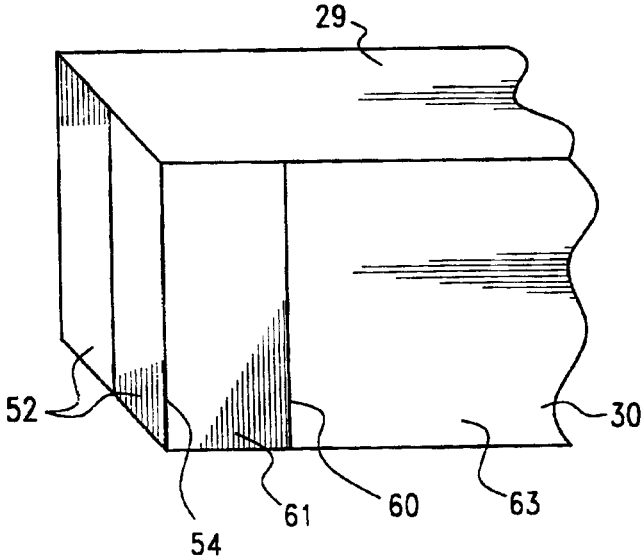

In a first configuration, a retaining tool such as a blade is passed adjacent the end of the shorter walls 30 and within the length of the longer walls 29 to be disposed intermediate the compressed article and the plunger. The plunger is then retracted as the blade holds the article in the compressed state. The retaining flaps 51 are then folded inward and taped or stapled together, or retained mechanically. The blade is withdrawn and the connected retaining flaps 51 hold the article in the compressed state in the container. The closure flaps 52 are then folded upward about fold lines 60 to generally align the respective fold lines 54 in the flaps with the end of the container 20, and the closure flaps 52 are then folded along the fold lines 54 to overlie the retaining flaps 51. The closure flaps 52 are connected such as by tape, staples or glue. Various stages of closure in the first configuration are shown in FIGS. 4, 5 and 6. The container 20 can be closed by the use of a strap that will be discussed in more detail below.

In an alternative closing of the container, different stages of which are shown in FIGS. 7, 8 9 and 10, a retaining tool is employed to fold the end portions 61 inward so that they contact the trailing end 44 and hold the article 40 in a compressed state. The retaining tool can be of any configuration known in the art and may for example consist of a pair of mechanically operated arms. The end portions 61 are now angled to approach the limiting plane 58.

Typically, the retaining flaps 51 extend from the primary fold line 54 to a distance greater than that between the primary and secondary fold lines 54 and 60. Therefore, while the end portions are 61 are held against the trailing end 44 of the article 40, the corresponding retaining flaps 51 are folded inward to partially close the container.

Figure 7:
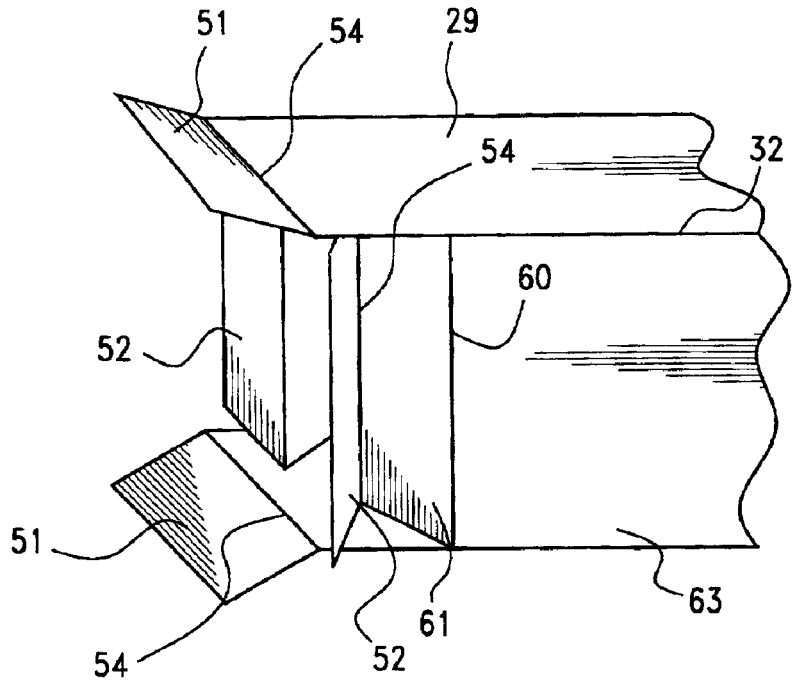
FIGS. 7–10 are perspective view of one end of a second configuration of the container at various stages of closure.
Figure 8:
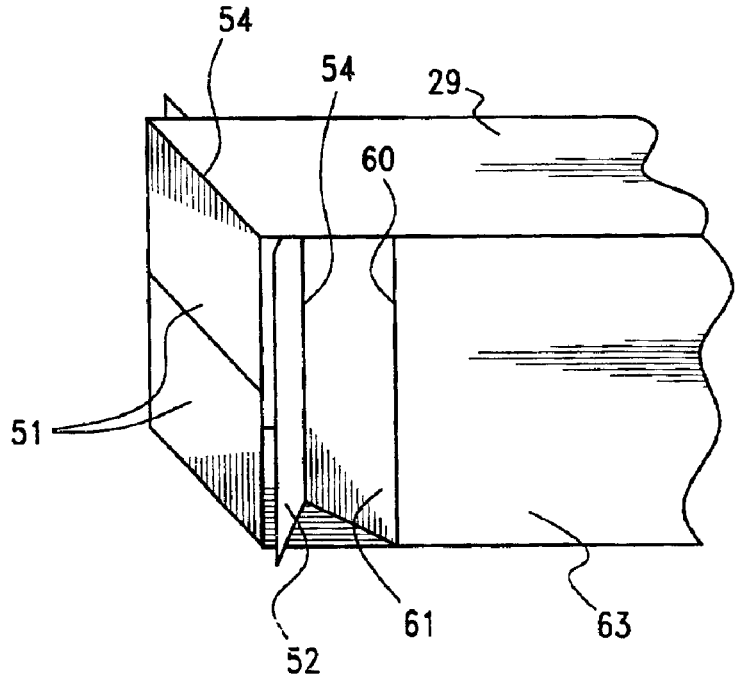
Figure 9:
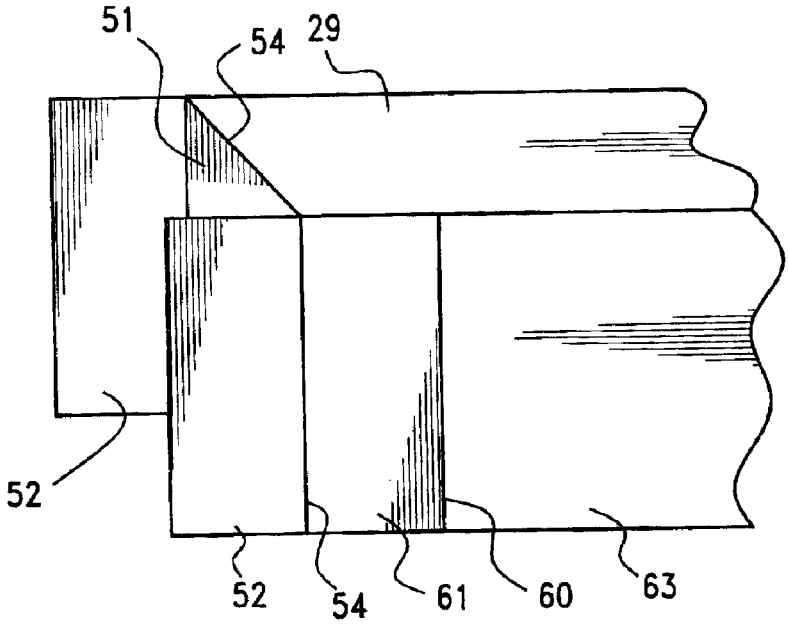
Figure 10:
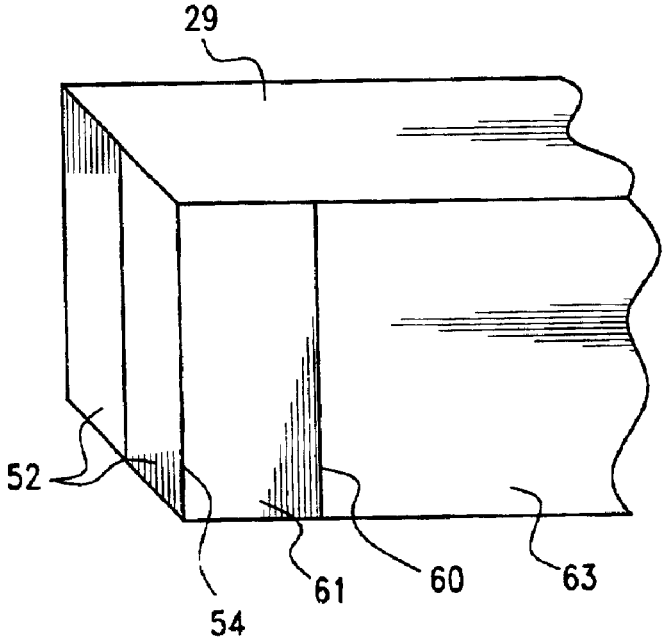

While the end portions 61 retain the article 40 in its compressed state, the retaining flaps 51 are folded inward until they meet or overlap which could be two full flaps over the opening 24. The retaining flaps 51 are maintained in this configuration by an appropriate attaching such as tape, staples, interlocking, adhesives or glue, and the tool is removed from the end portions 61, which are now free to be withdrawn from the trailing end 44 until they are co-planar with the main portions 63, as shown in FIG. 9. At this point the compressed article 40 can expand to fill the entire length of the container 20, wherein it is held by the closed retaining flaps 51. The closure flaps 52 can now folded inward about their primary fold lines 54 to cover the already closed retaining flaps 51, as shown in FIG. 7, thereby completely closing the first end 22 which can be sealed closed by appropriate means such as glue or tape. For example, the first end 22 can be sealed by a taping together the closure flaps 52. Optionally, a taping operation may also simultaneously be used to cover the slits 56.

Figure 11:
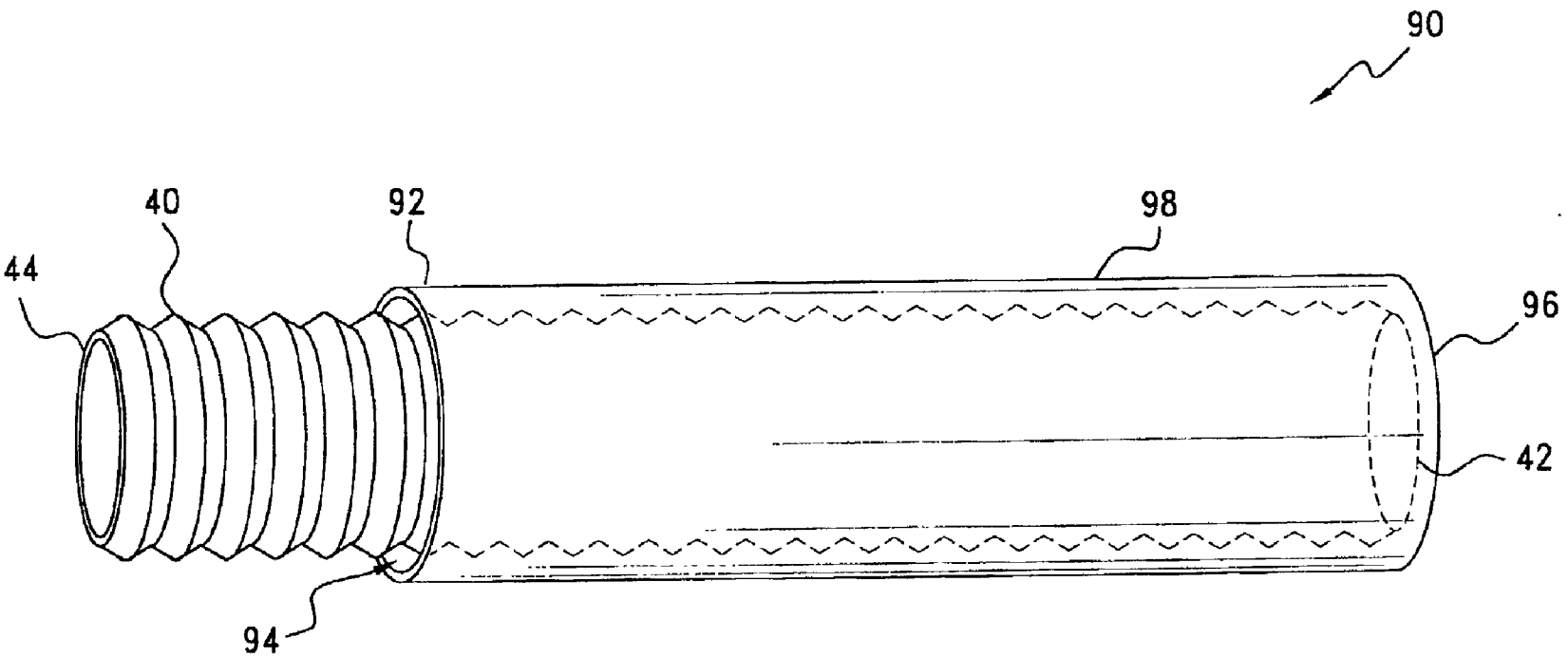
FIG. 11 is a perspective view of another container containing an uncompressed article.

Shown in FIG. 11 is another embodiment of packaging container 90 preferably constructed from a flexible material such as a plastic or similar material. The packaging container 90 has the general shape of an elongated cylinder, with a first end 92 in which is provided an opening 94, a closed end 96, and sides 98. If the cylinder has more than one side 98, the adjacent sides meet at seams (not shown). FIG. 11 shows the container 90 with a compressible article 40 inserted therein through the opening 94. The article 40 is depicted in an uncompressed form, with a leading end 42 abutting the closed end 96 of the container 90, and a trailing end 44 projecting outside the container 90.

The container 90 is employed as follows. The compressible article 40, for example a length of flexible duct, is inserted through the opening 94 until the leading end 42 of the article 40 abuts the closed end 96 of the container 90. The article 40 is then compressed into the container 90 by a suitable apparatus such as a ram or plunger, until the trailing end 44 has passed the end of the container 90.

Figure 12:
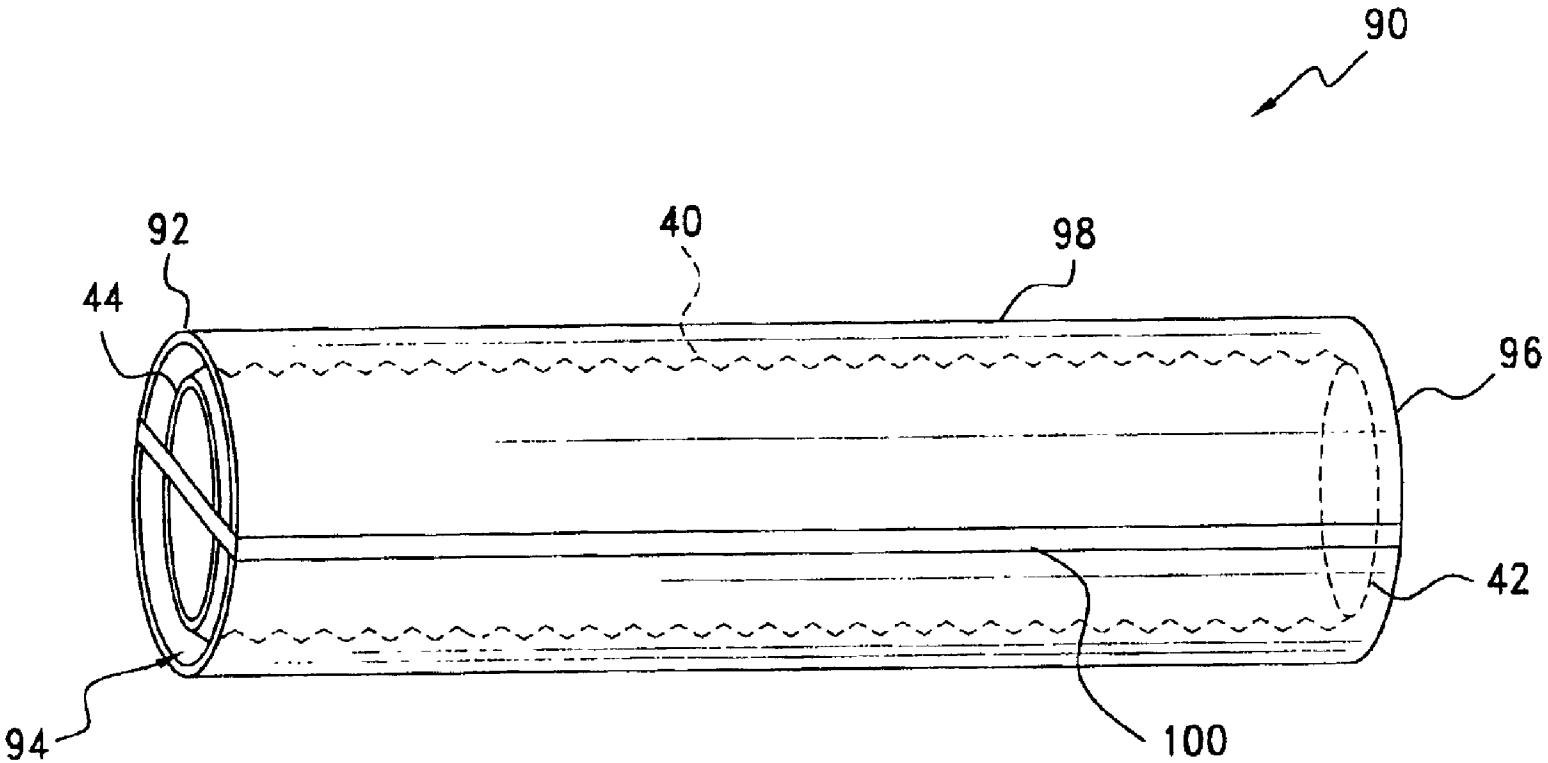
FIG. 12 is a perspective view of the container with a compressed article, strapped in the container.

In a first configuration, a retaining tool such as a blade is passed adjacent the sides 98 so that part of the flexible material is drawn down so the article in the compressed state. The first end 92 of the container 90 is connected by one or more straps 100 as shown in FIG. 12. Various forms of closure are possible with a flexible material using a strap 100. For example, the first end 92 can be sealed by a taping together the first end 92 and then attaching the strap 100.

Another alternative method of compressing and retaining the longitudinally compressible article 40 is to use a retaining tool, such as the blade and plunger discussed above, to compress the longitudinally compressible article 40 such that one or more permanent longitudinal restraints surround the longitudinally compressed article. The longitudinally compressible article 40 may be placed in a flexible bag before being compressed if desired. The plunger is then retracted as the blade holds the article in the compressed state. The permanent longitudinal restraints are then secured using techniques known in the art such as by heat fusing, stapling, or other well-known securing techniques. The blade is withdrawn and the permanent longitudinal restraints hold the article in the compressed state.

The longitudinally compressed article can be restrained in conjunction to the packaging methods described above. If this is done, the restraints are a back up to the restraining container. If the two methods are combined, the permanent restraints are placed around the longitudinally compressed article before it is placed in the container in a compressed or partially compressed state. Alternatively the restraints can surround the longitudinally compressible article 40 in the container before the longitudinally compressible article 40 is compressed. The permanent restraints would then be secured before the container is secured.

While the invention has been described in connection with a particular embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A longitudinally compressible flexible duct container, comprising:

(a) first and second opposed sides of a substantially equal given width having a first length;

(b) a first pair of flaps attached to an end of the first and second opposed sides defining an end of the container, (c) third and fourth opposed sides of the same substantially equal given width and having a second shorter length; and (d) a second pair of flaps attached to the third and fourth sides, the second pair of flaps having a fold line approximately aligned with the end of the container.

2. The longitudinally compressible flexible duct container of claim 1, wherein the first pair of flaps are hingedly connected to the respective first and second walls at a fold line and the second pair of flaps are hingedly connected to the respective third and fourth opposed sides at a secondary fold line.

3. The longitudinally compressible flexible duct container of claim 1 capable of containing a compressible flexible duct.

4. A closable longitudinally compressible flexible duct container, comprising:

(a) a compressible flexible duct in the container;

(b) the container including a plurality of walls forming a closed end and an open end;

(c) a retaining flap plvotally connected to one of the plurality of walls along a first fold line, the retaining flap adjacent an end of the compressible flexible duct; and (d) a closure flap pivotally connected to a second wall along a second fold line, the first and the second fold lines located with the closure flap being longer than the retaining flap, the closure flap overlying the retaining flap to dispose the retaining flap intermediate the compressible flexible duct and the closure flap.

5. A blank for forming a longitudinally compressible flexible duct container, comprising:

(a) four alternate first and second rectangular container wall forming sections, each section having a substantially equal width and joined along one of a series of parallel corner fold lines to at least one adjacent section;

(b) an end line defining one end of the container, wherefrom silts extend along the corner fold lines, the slits terminating at a limit line which is parallel to the end line;

(c) a primary fold line along the end line in each rectangular container wall forming section to define a corresponding flap, each corresponding flap having a length of approximately one half the width; and (d) a secondary fold line in the flap of each of the first rectangular container wall forming sections, the secondary fold line coinciding with the limit line, and defining an side portion which extends therefrom to the primary fold line.

6. The blank of claim 5, further comprising a glue flap joined to one of the rectangular container wail forming sections only along an edge fold line which is parallel to the corner fold lines.

7. A restrained longitudinally compressible flexible duct package, comprising:

(a) a longitudinally compressible flexible duct;

(b) first and second opposed sides of substantially equal width having a first length;

(c) a first pair of flaps attached to an end of the first and second opposed sides defining an end of the container;

(d) third and fourth opposed sides of substantially the same equal width as the first and second sides, having a second shorter length; and (e) a second pair of flaps attached to the third and fourth sides, the second pair of flaps having a fold line approximately aligned with the end of the container.

8. The package of claim 7 further comprising closure flaps with a restraining strap, for securing the duct.

9. A method of packing a longitudinally compressible flexible duct container, comprising:

(a) compressing an article to be packed in the container to dispose the article within the container, (b) engaging the compressed article with a temporary restraint;

(c) folding at least one restraining flap over an open end of the container to a restraining position;

(d) securing the one restraining flap in the restraining position;

(e) disengaging the temporary restraint from the compressed article; and (f) folding at least one closure flap to a closed position, the closure flap having a greater length then the retaining flap.

* * * * *